US007118008B2

(12) United States Patent
Hsu

(10) Patent No.: US 7,118,008 B2
(45) Date of Patent: Oct. 10, 2006

(54) LABEL TAG DISPENSER

(76) Inventor: Nick Hsu, 8F-1, No. 424, Chungming Rd., Taichung (TW)

( * ) Notice: Subject to any disclaimer, the term of this patent is extended or adjusted under 35 U.S.C. 154(b) by 112 days.

(21) Appl. No.: 11/045,321

(22) Filed: Jan. 31, 2005

(65) Prior Publication Data

US 2006/0169711 A1 Aug. 3, 2006

(51) Int. Cl.

| | |
|---|---|
| ***B65H 1/00*** | (2006.01) |
| ***B65G 59/00*** | (2006.01) |
| ***A47K 10/24*** | (2006.01) |
| ***B65D 45/16*** | (2006.01) |

(52) U.S. Cl. ..... 221/45; 221/34; 221/286; 220/324

(58) Field of Classification Search ..... 221/63, 221/45, 46, 33, 52, 61, 282, 281, 185, 286; 220/345.1, 345.2, 345.3, 522, 524, 324; 222/609, 222/183, 182; 215/321, 43

See application file for complete search history.

(56) References Cited

U.S. PATENT DOCUMENTS

| | | | | | |
|---|---|---|---|---|---|
| 2,909,304 | A | * | 10/1959 | Powell | 222/130 |
| 3,463,309 | A | * | 8/1969 | Szostek | 206/470 |
| 4,058,212 | A | * | 11/1977 | Wyslotsky | 206/470 |
| 4,124,135 | A | * | 11/1978 | Weder et al. | 220/4.21 |
| 4,244,470 | A | * | 1/1981 | Burnham | 206/525 |
| 4,431,114 | A | * | 2/1984 | Kleinfeld | 220/835 |
| 4,605,227 | A | * | 8/1986 | Hurd et al. | 473/63 |
| 4,681,223 | A | * | 7/1987 | Roberts | 206/354 |
| 4,899,662 | A | * | 2/1990 | Santalucia et al. | 102/505 |
| 4,921,127 | A | * | 5/1990 | Windorski | 221/45 |
| 4,986,440 | A | * | 1/1991 | Windorski | 221/45 |
| 5,067,628 | A | * | 11/1991 | Evenson | 221/52 |
| 5,080,254 | A | * | 1/1992 | Feer | 221/33 |
| 5,143,250 | A | * | 9/1992 | Freitag | 221/59 |
| 5,174,607 | A | * | 12/1992 | Hill | 281/45 |
| 5,526,955 | A | * | 6/1996 | Windorski et al. | 221/34 |
| 5,779,101 | A | * | 7/1998 | Holmgren et al. | 222/130 |
| 5,927,488 | A | * | 7/1999 | Gray | 206/237 |
| 5,964,375 | A | * | 10/1999 | Carlson et al. | 221/45 |
| 6,050,438 | A | * | 4/2000 | Kovens et al. | 220/4.24 |
| 6,361,075 | B1 | * | 3/2002 | Ritter et al. | 281/44 |
| 6,514,585 | B1 | * | 2/2003 | Pearson et al. | 428/40.1 |
| 6,796,429 | B1 | * | 9/2004 | Cameron et al. | 206/440 |
| 6,945,395 | B1 | * | 9/2005 | Hsu | 206/308.1 |
| 2005/0109790 | A1 | * | 5/2005 | Hsu | 221/34 |

* cited by examiner

*Primary Examiner*—Kathy Matecki
*Assistant Examiner*—Rakesh Kumar
(74) *Attorney, Agent, or Firm*—Bacon & Thomas

(57) ABSTRACT

A label tag dispenser has a base, a cassette mount for placing a paster cassette and two semi-shells symmetrical with each other. The cassette has an outer periphery and at least one groove is defined in the outer periphery. Each semi-shell has an open end, an inner periphery, at least one rib formed on the inner periphery to match with the at least one groove and a cutout defined at the open end. By engaging the groove and the rib, the two semi-shells can be individually mounted on the cassette mount. One semi-shell is mounted and then the paster cassette can be received inside the label tag dispenser with its first paster sheet extending upward through the cutout. Then, the other semi-shell is mounted to achieve the label tag dispenser. Thereby, the label tag dispenser is conveniently reloaded with a new paster cassette without nuisance concerning slippage of the paster sheet.

6 Claims, 8 Drawing Sheets

LABEL TAG DISPENSER

BACKGROUND OF THE INVENTION

1. Field of the Invention

The present invention relates to a label tag dispenser, and more particularly to a dispenser in which it is easy to reload a new paster cassette in a convenient way.

2. Description of Related Art

With reference to FIGS. 7 and 8, a conventional label tag dispenser comprises a base (50), a cassette mount (60) for receiving the paster cassette (80) and a cover (70). The paster cassette (80) contains multiple paster sheets (81) that can be drawn out one by one.

The base (50) has a bottom board (52) and a ballast stay (54) attached on the bottom board (52). The bottom board (52) is rectangular and has two ends and a cutout (520) defined at one end. The ballast stay (54) is also rectangular and has a cutout (540) corresponding to the cutout (520) on the bottom board (52).

The cassette mount (60) is a substantially rectangular casing mounted on the bottom board (52) to enclose the ballast stay (54) with the bottom board (52). The cassette mount (60) has two ends, an outer periphery, a top face, a stop strip (62), multiple stubs (64) and a cutout (66). The stop strip (62) is formed on the top face of the cassette mount (60) near one end to prevent the paster cassette (80) sliding on the cassette mount (60). The multiple stubs (64) are respectively formed on the outer periphery at the two ends. The cutout (66) is defined in the end that is close to the stop strip (62) to align with the cutouts (540, 520) on the base (50).

The cover (70) is also a substantially rectangular casing mounted on the bottom board (52). The cover (70) has two ends, an inner periphery, a top face, an opening (72) and multiple detents (74). The cover (70) is slightly larger than the cassette mount (60) in size and its two ends abut the ends of the cassette mount (60) when the cover (70) mounted on the bottom board (52). However, the cover (70) has a height much greater than that of the cassette mount (60) so that a compartment is defined between the top faces of the cover (70) and the cassette mount (60) to receive the paster cassette (80). The opening (72) is defined in the top face of the cover (70) to allow a paster sheet (81) to extend therethrough. The multiple detents (74) are respectively defined on the inner periphery at the two ends to correspondingly engage the multiple stubs on the cassette mount (60) to keep the cover (70) secured on the cassette mount (60).

However, the conventional label tag dispenser has a drawback in that the replacement of the paster cassette (80) is inconvenient because the first paster sheet (81) does not extend through the opening (72) when the cover (70) is remounted on the bottom board (52). Therefore, the paster cassette (80) has to be attached under the cover (70) to make the first paster sheet (81) extend out via the opening (72) initially. Then, the paster cassette (80) is pushed to abut the cover (70) to keep the first paster sheet (81) through the opening (72). Lastly, the cover (70) with the paster cassette (80) has to be released from hand and swiftly mounted on the base (50) before the first paster sheet (81) escapes from the opening (72) during the attachment of the cover (70). Additionally, even when the first paster sheet (81) is extended through the opening (72), the paster cassette (80) may slide inside the dispenser and finally makes the paster sheet (81) escape from the opening (72) again.

To overcome the shortcomings, the present invention provides an improved label tag dispenser to obviate the aforementioned problems.

SUMMARY OF THE INVENTION

The main objective of the invention is to provide a label tag dispenser that can be reloaded conveniently.

Other objects, advantages and novel features of the invention will become more apparent from the following detailed description when taken in conjunction with the accompanying drawings.

DETAILED DESCRIPTION OF PREFERRED EMBODIMENT

A label tag dispenser in accordance with the present invention comprises a base, a cassette mount for receiving a paster cassette and two semi-shells symmetrical with each other. The cassette has an outer periphery and at least one groove is defined in the outer periphery. Each semi-shell has an open end, an inner periphery, at least one rib formed on the inner periphery to match with the at least one groove and a cutout defined at the open end. By engaging the groove and the rib, the two semi-shells can be individually mounted on the cassette mount. One semi-shell is mounted and then the paster cassette can be received inside the label tag dispenser with its first paster sheet extending upward through the cutout. Then, the other semi-shell is mounted to achieve complete assembly of the label tag dispenser. Thereby, the label tag dispenser is conveniently reloaded with a new paster cassette without nuisance involving retraction of the paster sheet.

Figure 1:
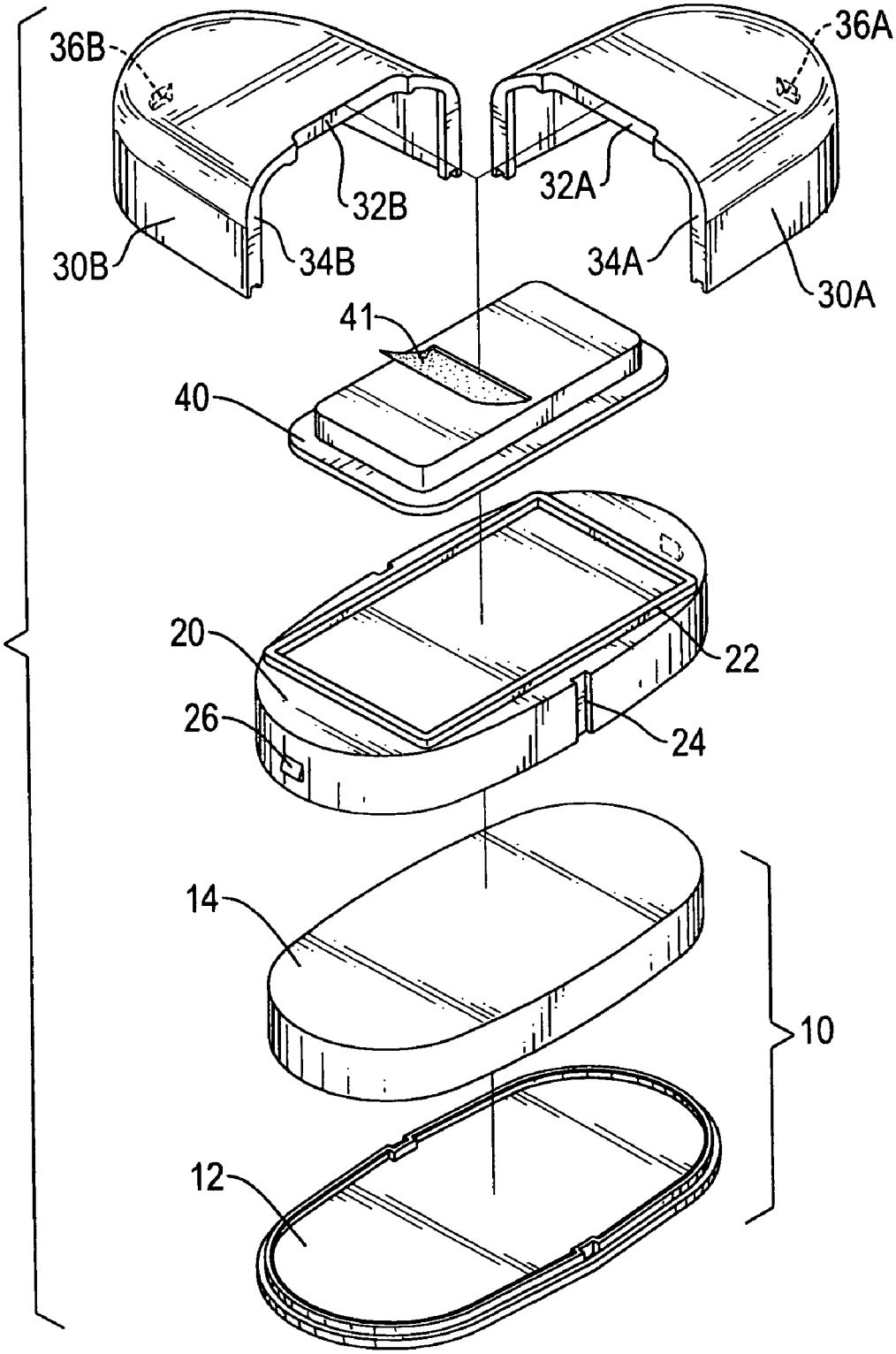
FIG. 1 is an exploded perspective view of a label tag dispenser in accordance with the present invention.
Figure 4:
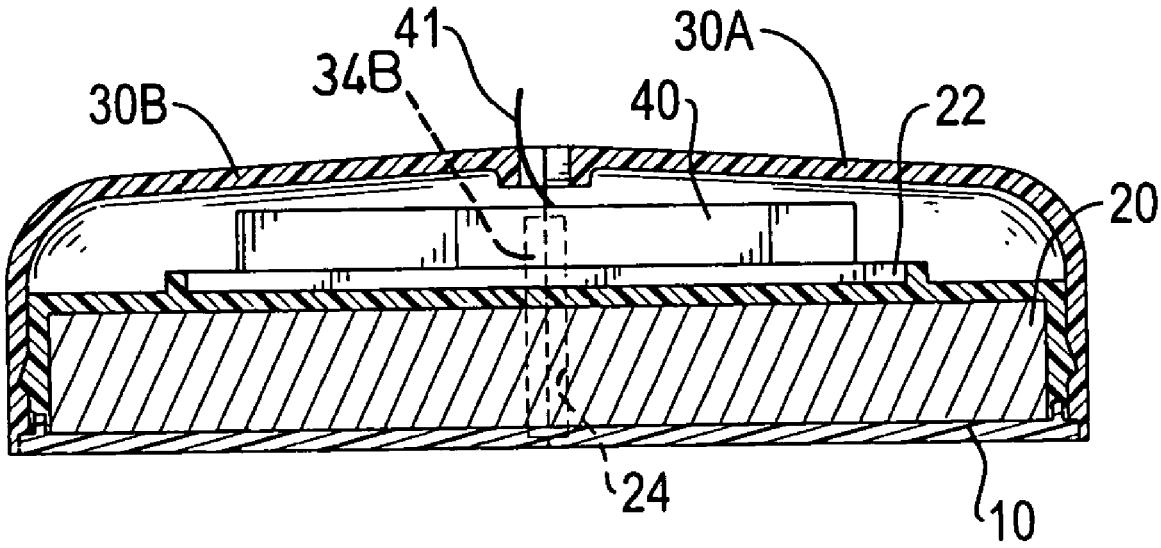
FIG. 4 is a cross-sectional side view of the label tag dispenser after combination of the paster cassette and label tag dispenser.

With reference to FIGS. 1 and 4, a preferred embodiment of the label tag dispenser in the present invention comprises a base (10), a cassette mount (20) adapted to hold a paster cassette (40) and a cover composed of two symmetrical semi-shells (30A, 30B).

The base (10) has an oval bottom board (12) and a ballast stay (14). The ballast stay (14) is immovably mounted on the bottom board (12).

The cassette mount (20) is mounted on the base (10) to enclose the ballast stay (14). The cassette mount (20) is an oval casing having a top face, an outer periphery, two ends, two sides, a margin (22), two grooves (24), and two stubs (26). The margin (22) is formed on the top face for fittingly receiving the paster cassette (40). The two grooves (24) are respectively and vertically defined on the outer periphery at the two sides. The two stubs (26) are respectively formed on the outer periphery at the two ends.

The two symmetrical semi-shells (30A, 30B) are used to compose an oval casing larger than the cassette mount (20). Each semi-shell (30A, 30B) has a top face, an inner periphery, a closed end, an open end with two sides, a cutout (32A, 32B), a detent (36A, 36B) and two ribs (34A, 34B). The cutout (32A) of the semi-shell (30A) is defined in the top face at the open end to correspondingly align with the other cutout (32B) on the other semi-shell (30B) to perform an elongated opening. The two ribs (34A) are respectively formed on the inner periphery at the two sides of the open end and correspondingly engage the grooves (24) on the cassette mount (20). Wherein, each groove (24) receives two ribs (34A, 34B) respectively on the two symmetrical semi-shells (30A, 30B) when the label tag dispenser is achieved. The detent (36A) is formed on the inner periphery at the closed end to correspondingly engage the stub (26) on the cassette mount (20).

Figure 2:
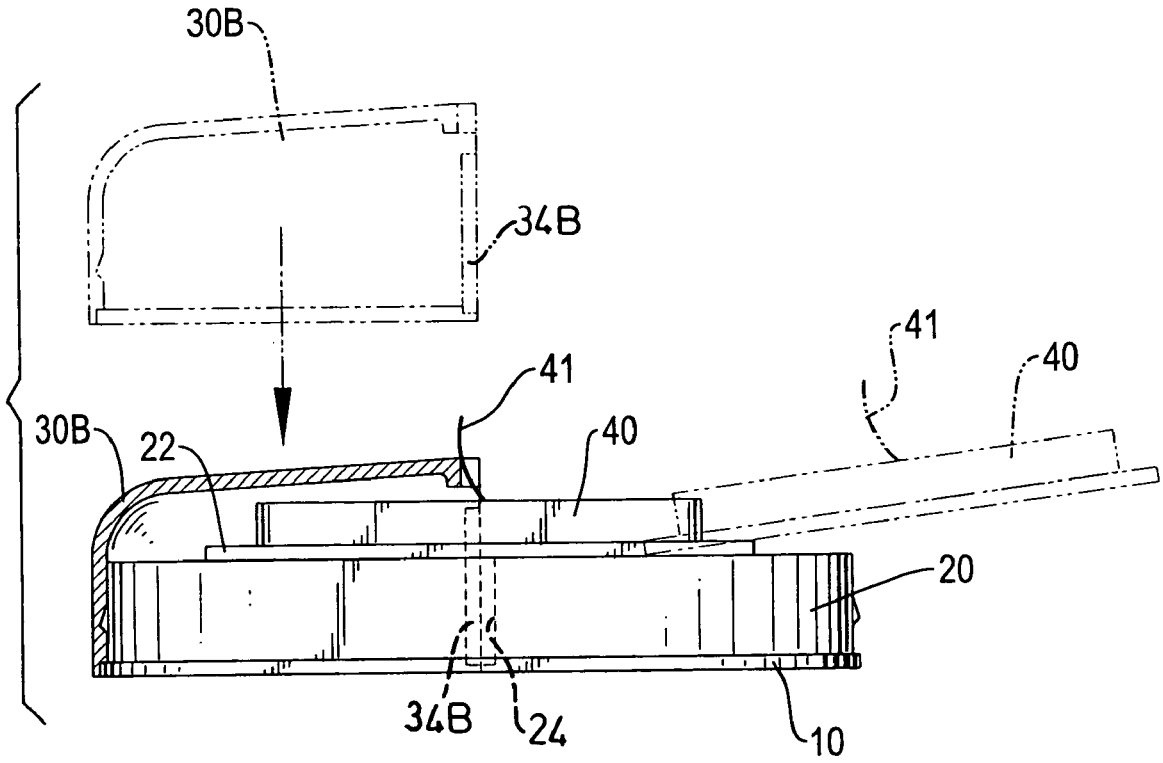
FIG. 2 is an operational cross-sectional side view of the label tag dispenser in FIG. 1.
Figure 3:
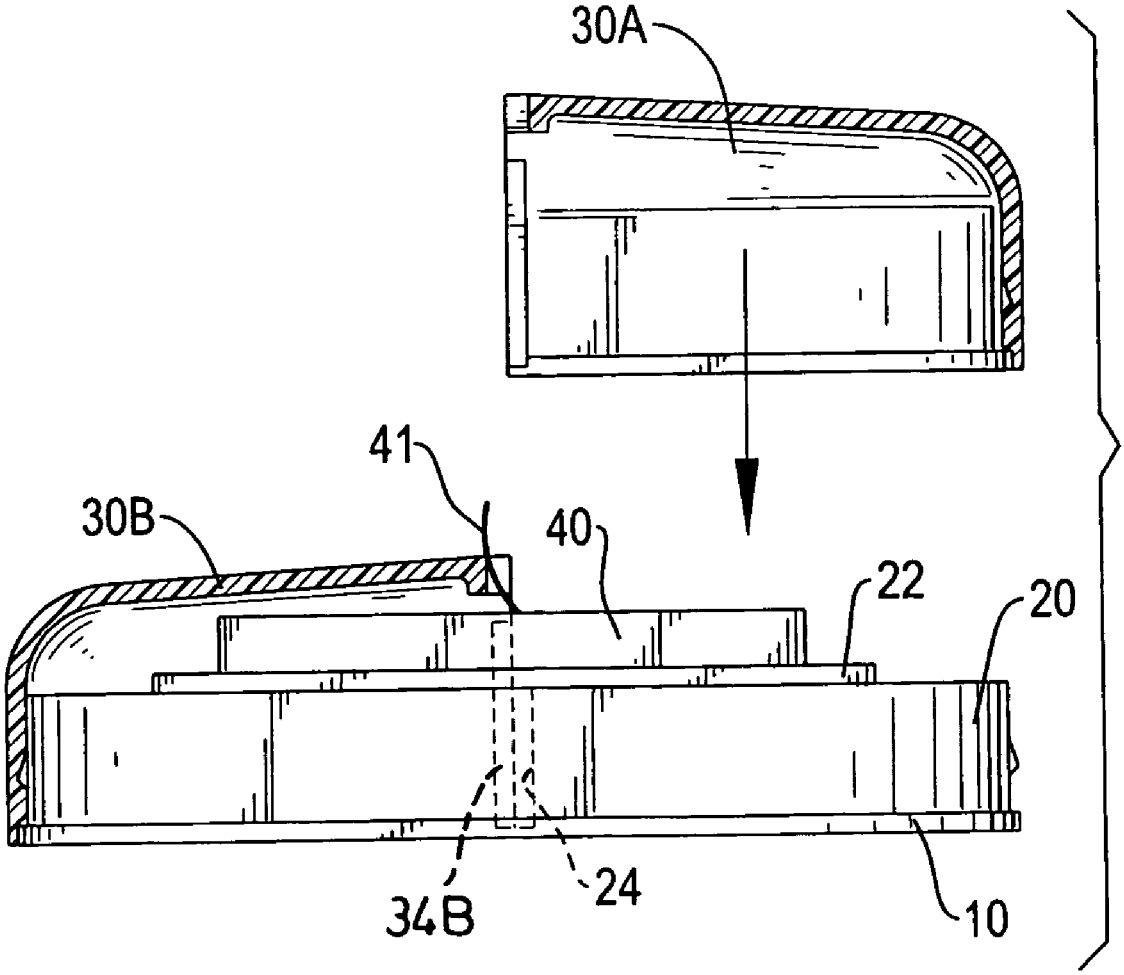
FIG. 3 is an another operational cross-sectional side view of the label tag dispenser in FIG. 1.

With reference to FIGS. 2 to 4, when the label tag dispenser is assembled, one semi-shell (30B) is mounted on the cassette mount (20) first by sliding the ribs (34B) into the corresponding grooves (24). Then, the paster cassette (40) slides along the top face of the cassette mount (20) until the paster cassette (40) is fitted to the margin (22) and partially inserted between the semi-shell (30B) and cassette mount (20). Lastly, the other semi-shell (30A) is mounted on the cassette mount (20) to complete the label tag dispenser. When the paster cassette (40) slides to position within the margin (22), a first paster sheet (41) extending upward abuts the open end of the semi-shell (30B) in the cutout (32B) to emerge from the semi-shell (30B) without need for any other action. Therefore, combination of the label tag dispenser is convenient and easy.

Figure 5:
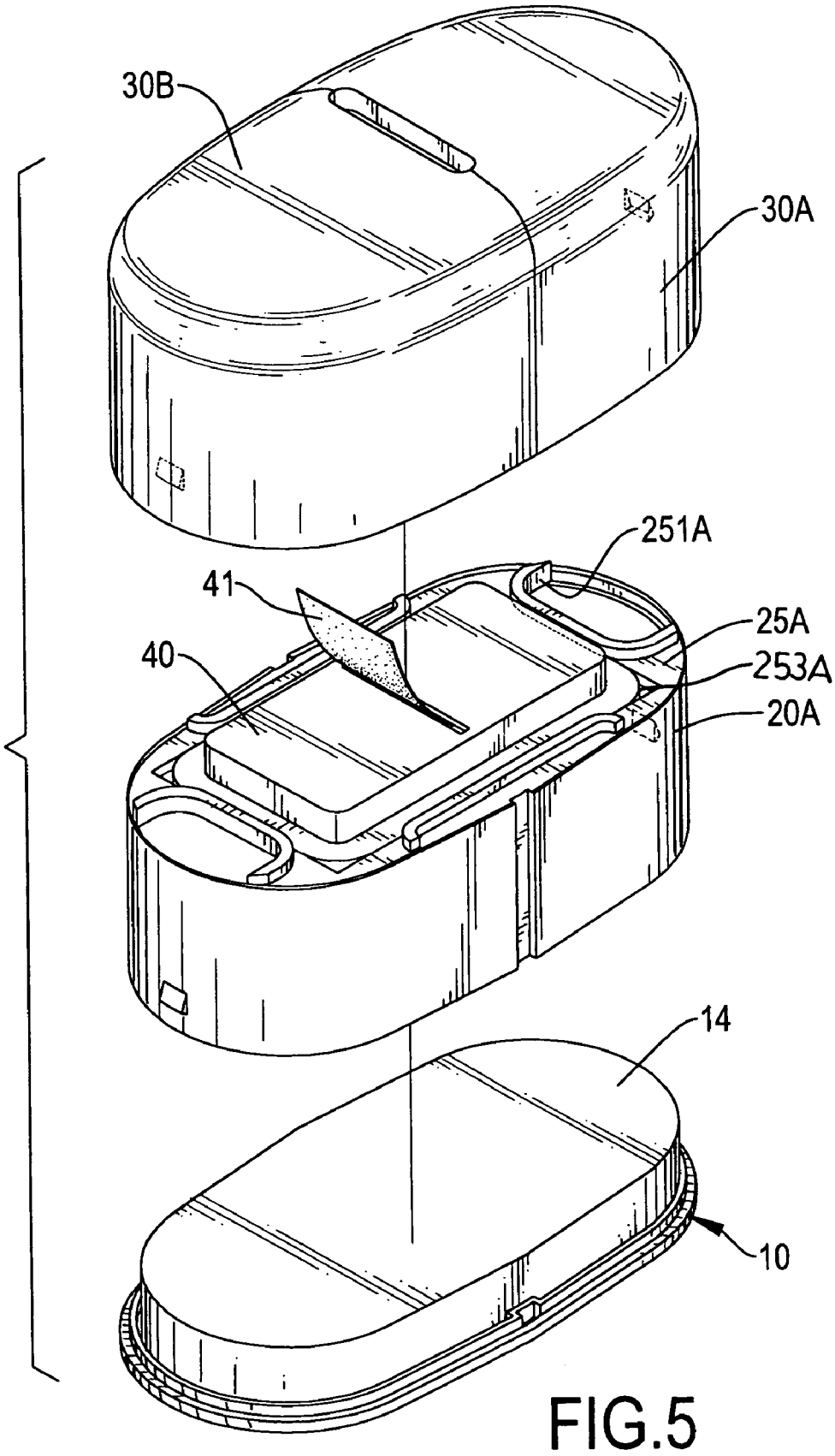
FIG. 5 is an exploded perspective view of another embodiment of the label tag dispenser in accordance with the present invention.
Figure 6:
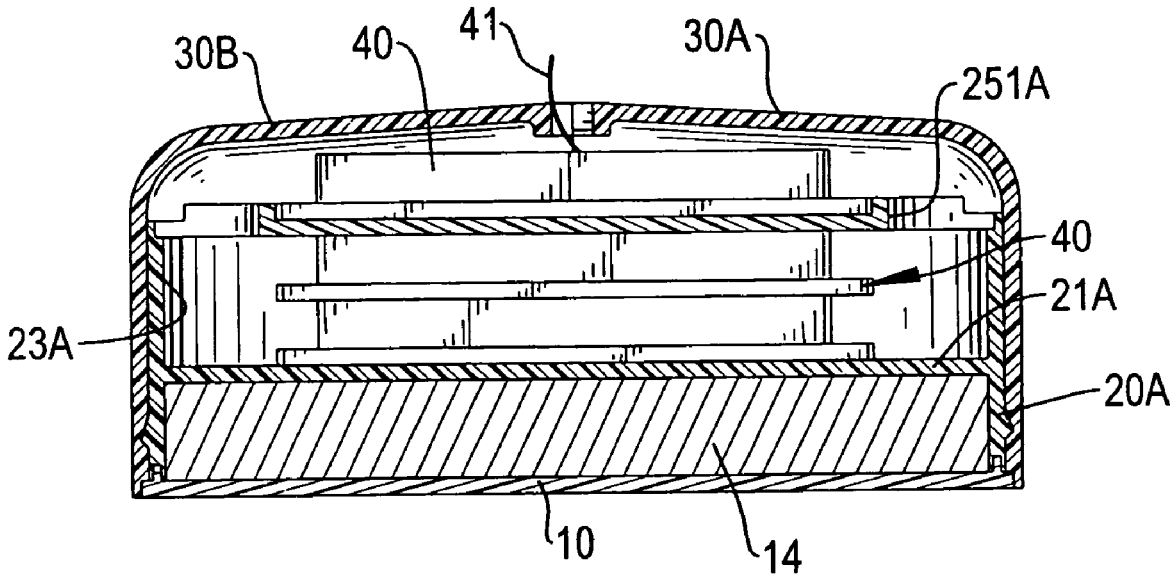
FIG. 6 is a cross-sectional side view of the label tag dispenser in FIG. 5 after combination of the paster cassette and the label tag dispenser.
Figure 7:
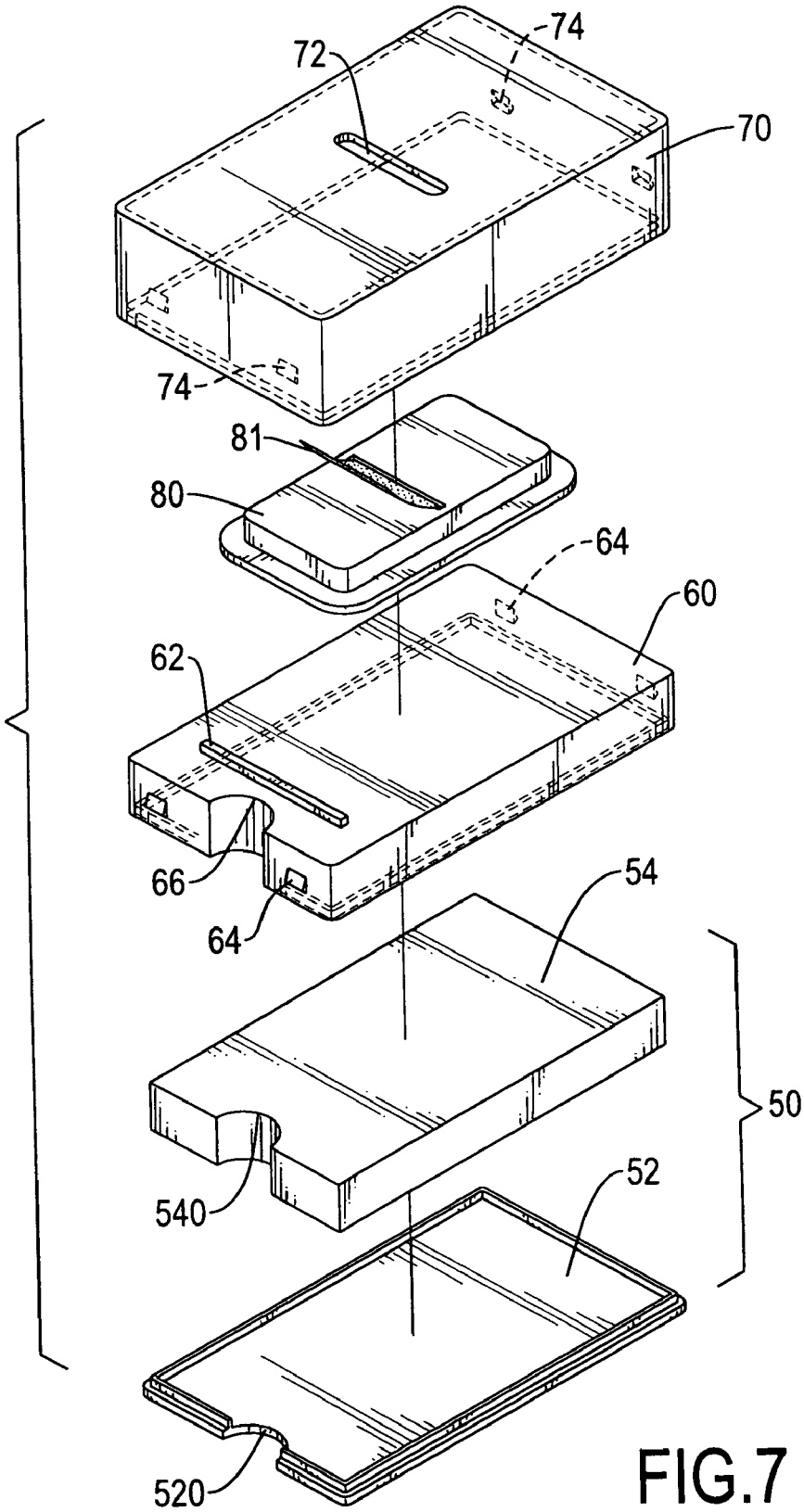
FIG.7 PRIOR ART
FIG. 7 is an exploded perspective view of a conventional label tag dispenser in accordance with the prior art.
Figure 8:
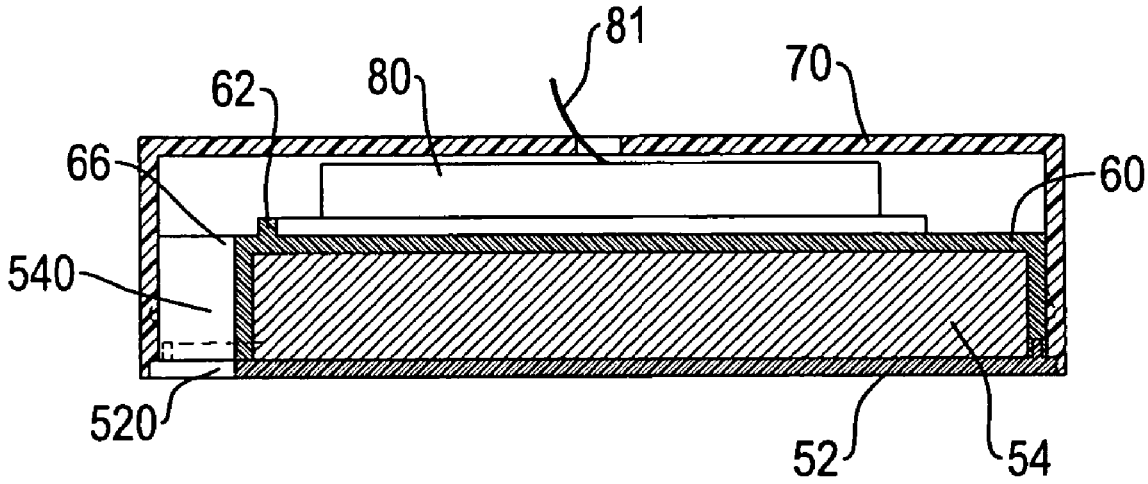
FIG.8 PRIOR ART
FIG. 8 is a cross-sectional side view of the conventional label tag dispenser in FIG. 7 after combination of the paster cassette and the label tag dispenser.

With reference to FIGS. 5 and 6, another preferred embodiment of the label tag dispenser has the same structure except the cassette mount (20A) is heightened to further have a spare compartment. The cassette mount (20A) has a dividing board (21A) and a detachable top board (25A) to define the spare compartment within the casing for storing spare paster cassettes inside. The top board (25A) has a top face, two ends, a recess (253A) and two holding holes (251A). The recess (253A) is defined on the top face to hold the paster cassette (40). The two holding holes (251A) are respectively defined through the top board (25A). Therefore, a user can move the top board (25A) by holding it via the holding holes (251A).

According to the combination procedure of the label tag dispenser in the present invention, it is understandable that the first paster sheet (41) on the paster cassette (40) certainly extends through the opening of the label tag dispenser and is retained until after refitting the two symmetrical semi-shells (30A, 30B). Therefore, the drawbacks of the conventional label tag dispenser in reassembly are eliminated.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A label tag dispenser comprising:

a base;

a cassette mount mounted on the base and having a top face, an outer periphery, two ends, two sides and at least one groove transversally defined in the outer periphery; and two symmetrical semi-shells detachably mounted on the cassette mount to compose a cover, wherein each semi-shell has a top face, an inner periphery, a closed end, an open end, a cutout defined through the top face at the open end and at least one rib defined on the inner periphery to engage the at least one groove on the cassette mount.

2. The label tag dispenser as claimed in claim 1, wherein the cassette mount further has a margin formed on the top face of the cassette mount.

3. The label tag dispenser as claimed in claim 1, wherein cassette mount further has two stubs respectively formed at the two ends of the cassette mount; and the two semi-shells have two detents respectively defined in the inner periphery at the two closed ends to engage the stubs on the cassette mount.

4. The label tag dispenser as claimed in claim 2, wherein cassette mount further has two stubs respectively formed at the two ends of the cassette mount; and the two semi-shells have two detents respectively defined in the inner periphery at the two closed ends to engage the stubs on the cassette mount.

5. The label tag dispenser as claimed in claim 1, wherein cassette mount further has a dividing board formed in the cassette mount and a detachable top board mounted over the dividing board to define a spare compartment;

wherein, the top board has the top face, two ends, a recess defined on the top face of the top board and two holding holes respectively defined through the top board at the two ends.

6. The label tag dispenser as claimed in claim 3, wherein cassette mount further has a dividing board formed in the cassette mount and a detachable top board mounted over the dividing board to define a spare compartment;

wherein, the top board has the top face, two ends, a recess defined on the top face of the top board and two holding holes respectively defined through the top board at the two ends.

* * * * *